United States Patent [19]

Morgan

[11] 3,995,246

[45] Nov. 30, 1976

[54] DEVICE FOR CONTROLLING THE TEMPERATURE AND PROTECTING AGAINST EXCESSIVE FLOW OF CURRENT OF ELECTRIC INSTALLATIONS

[76] Inventor: John M. Morgan, 42, Frans Halslaan, Arnhem, Netherlands

[22] Filed: Feb. 4, 1975

[21] Appl. No.: 546,993

[52] U.S. Cl. ..... 337/407; 317/40 A; 337/404

[51] Int. Cl.[2] ..... H01H 37/76

[58] Field of Search ..... 337/404, 405, 407, 414, 337/178, 188, 182; 219/517; 317/40 A, 41

[56] References Cited

UNITED STATES PATENTS

| | | | |
|---|---|---|---|
| 481,989 | 9/1892 | Wilson | 337/407 |
| 501,653 | 7/1893 | Havard | 337/407 |
| 643,179 | 2/1900 | Woodman | 337/407 |
| 791,882 | 6/1905 | Cornelison | 337/407 |
| 2,548,491 | 4/1951 | Peek, Jr. | 317/40 A |
| 3,602,864 | 8/1971 | Burney | 337/407 |

*Primary Examiner*—Harold Broome
*Attorney, Agent, or Firm*—Karl W. Flocks

[57] ABSTRACT

A device for controlling the temperature and protecting against excessive flow of current of electric installations, said device being provided with a mechanical switch which opens itself at a definite previously selected temperature, said mechanical switch comprising cylindrical housing wherein two elastic contact means are provided, one of the contact means comprising an open spring spiral torsion with bent ends which is provided around a melting body of thermally softenable material and is pressed with a tension directly against the spring action of the other contact means.

9 Claims, 7 Drawing Figures

DEVICE FOR CONTROLLING THE TEMPERATURE AND PROTECTING AGAINST EXCESSIVE FLOW OF CURRENT OF ELECTRIC INSTALLATIONS

BACKGROUND OF THE INVENTION

The invention relates to a device for controlling the temperature and protecting against excessive flow of current of electric installations, said device being provided with a mechanical switch which opens itself at a definite previously selected temperature. This kind of temperature control device is described in publications of the applicant. This kind of device offers the advantage of being available for immediate and safe use in a variety of appliances because normally bimetallic thermostats are required to be prooftested for switching movements of 100.000, 200.000 and even higher reliability, on account of the inherent dangers in household use when failure of the thermostat would result in an uncontrolled rise of temperature with possible fire risks.

The object of the present invention is to provide a device for controlling the temperature and protecting against excessive flow of current of electric installations, whereby a control device may be obtained having very small dimensions and said device meets security regulations.

SUMMARY OF THE INVENTION

Therefore the device of the invention is characterized in that the mechanical switch comprises a cylindrical housing wherein two elastic contact means are provided, one of the contact means comprising an open spring-ring with bent ends which is provided around a melting body of thermally softenable material and is pressed with a tension directly against the spring action of the other contact means.

A further embodiment of the device according to the invention is characterized in that the open spring-ring presses with its bent end from the lower side against the other resilient contact means with force which is directed against the spring of the contact means so that when on collapsing of the fusible body the spring ring presses itself into the closed position, the contact means moves downwardly owing to its spring tension and opens the contact.

A further embodiment of the device according to the invention is characterized in that the mechanical switch comprises a cylindrical housing wherein two elastic contact means are provided, one of the contact means comprising an open spring ring with bent ends which is provided around a melting body of thermally softenable material and is pressed with a tension directly against the spring action of the other contact means.

On the cylindrical housing may be provided a cover with an oblong slot for fixing spring-ring-like contact means.

A further embodiment of the device according to the invention is characterized in that the other elastic contact means comprises a blade spring bent angularly which is introduced through a slot in the upper side of the back side of the housing, the upper width of the slot being narrower than the width of the spring.

According to the invention the housing may be provided with an inner profile which supports the spring-ring-shaped contact means, said profile also comprising an inclination against which the blade-spring-shaped contact means is pressed.

The melting body used in the device according to the invention is constituted by a meltable synthetic or organic material.

According to the invention there is also provided a device characterized in that a thermistor with positive temperature coefficient is connected in series with the mechanical switch. This gives the advantage that now a thermistor may be applied since the security condition may be fulfilled of an air opening of 2 mm at the interruption of the current at elevated temperature, so that in addition to making possible the replacement of a bimetallic thermostat with a thermistor, the invention therefore becomes immediately available for safe use without the necessity for proof-testing the chemico-resistance switching action of the thermistor.

It should be noted that the use of solid-state, positive temperature coefficient (PTC) materials to detect rises and falls in temperature is well-known. These are known as PTC thermistors.

These materials may be assembled in chemical compositions in the form of a solid rectilinear mass, a bead or a wound foil, the resultant shape constituting a resistance of generally low value which has the property of increasing its resistance with each degree Centigrade rise of temperature until a point, known as the "switching" temperature of Curie Point is reached, when the resistance/temperature curve rises steeply to value of several orders of magnitude over a small temperature region.

Use is made of this phenomenon by amplifying the change in resistance by means of electronic high-gain circuits and so converting the Curie Point region of the resistance/temperature curve into an electronic gate switch to turn on and off a power circuit, which is thus under the control of the PTC thermistor.

The resultant control achieved can be very precise, although involving complicated electronic circuitry, and therefore increased piece-parts to an appliance.

Attempts have also been made to use the PTC thermistor principle directly as a control, and even as a combined heater and controller of heat for small wattages of the order of 100W, thus obviating the need for bimetallic thermostats to control the desired temperature.

The disadvantage of using the thermistor as a direct control, or as a combined heater/controller, is that the resistance of the thermistor when significantly past its Curie Point is still insufficient to effectively isolate the appliance heater circuit, whether a wire-wound circuit or a sold state heater, from the line or mains supply. Regulations in this respect are very precise, and the U.S. and European Regulatory Authorities are not likely to be met in the foreseeable future by a device which presents 10.000 or so ohms resistance to a line circuit by chemical means in place of the insulation and voltage requirements which are met with an air gap switch of a minimum breakage distance through air of 2 mm.

The object of the present device is to overcome this difficulty, and to present a PTC thermistor as an integral unit of miniature form with a built in thermomechanical device which effectively isolates and insulates the mains supply in the event of a change in the chemical or mechanical properties of the thermistor.

Thus two advantages are realised in this invention simultaneously:

1. The use of the thermal link section of the device in conjunction both electrically and mechanically with the regulatory thermistor renders uncontrolled temperature rises in the device, and thus in the appliance impossible, even with failure of the regulatory thermistor.

2. The use of the thermal link section as above makes the use of the regulatory thermistor possible despite the fact that the thermistor continues to be connected to the mains supply, and even passes current, when it is effectively switched off. This is because any uncontrolled rise of temperature due to a defect in the thermistor, mechanical or electrical, beyond that limited by the thermal link, results in the latter permanently opening with a 2 mm air gap and the whole device must then be replaced. Electrical Authorities cannot therefore state that the use of a chemical thermistor is unsafe.

In practice, the use of different materials will fix the Curie Point of the thermistor and the thermal element of the thermal link will be selected for an opening temperature towards the upper end of the slope of the resistance/temperature curve when past the Curie Point.

As an example, a thermistor may present an insertion resistance of 100 ohms to a heater circuit at ambient temperature. A treated material, barium titanate or other material, is chosen so that its Curie Point occurs at 70° C when the resistance of the thermistor may be expected to rise steeply to about 10.000 ohms at 80° C. The value 80° C will not normally be expected to be reached as the sharp decrease in the heating current of the appliance will prevent this. Assuming the controlled heat of the environment fluctuates around 75° C due to overshoot and undershoot, a thermal element of the thermal link of 80° C could be chosen and all rises of temperature above this would be in the activating region in this thermal link and subject activation of the link within its designed response curve.

BRIEF DESCRIPTION OF THE DRAWINGS

The invention is now further to be described below with reference to the drawings in which, by way of example, an embodiment of the temperature controlling device, according to the invention, is illustrated and in which.

DESCRIPTION OF THE PREFERRED EMBODIMENT

Figure 1:
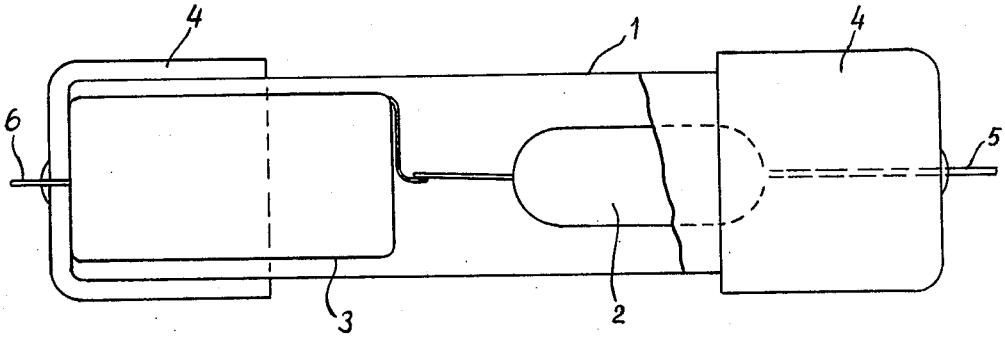
FIG. 1 shows a partially sectioned side view of a device for controlling the temperature and protecting against excess flow of current in electric installations according to the invention.

FIG. 1 shows an arrangement for controlling the temperature and protecting against excess flow of current in electric installations according to the invention, in which a glass or ceramic tube is indicated by the reference numeral I, and in which a positive temperature coefficient thermistor 2 and a mechanical switch 3 are arranged and which are electrically connected to one another. Metal protecting caps 4 are arranged on each end of the tube I with openings through which contact wires 5 and 6 extend from, respectively, the thermistor and the mechanical switch and which contact wires are affixed to the protecting caps by, for example, soldering thereto. The positive temperature coefficient thermistor and the mechanical switch are connected to each other by means of, for example, the soldering of their adjacently oriented contact wires.

Figure 3:
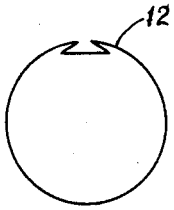
FIG. 3 shows a rear side view of the mechanical switch according to FIG. 2.
Figure 2:
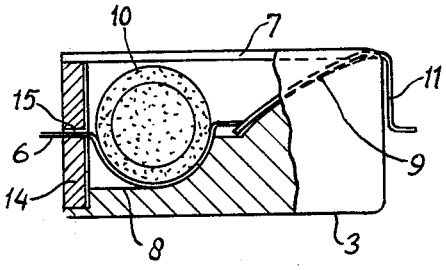
FIG. 2 shows, in section, a mechanical switch according to the invention which can be connected in series with a positive temperature coefficient thermistor according to FIG. 1.

FIG. 2 shows in partial section a mechanical switch according to FIG. 1, and which comprises a cylindrical housing of thermoplastic material 7 which is provided with an internal slot which has one end closed (FIG. 3) and the other end open (FIG. 4), the floor of the slot having a profiled portion 8 for the support of the fusible body 10 of annular form together with its retained ring-like spring 6 and a portion 9 for the reception of the resilient spring contact member 11, and the ceiling of the slot being open to a longitudinal slot which runs the length of the housing to the right-hand wall 12 shown in FIG. 3, this upper slot being of a swallow-tail shape and its lips separated to a dimension which is less than the width of the spring member 11.

FIG. 3 shows the right-hand or closed end of the housing and the swallow-tail formed by the open slot at the top of the housing. This swallow-tail serves to locate the resilient spring 11 which fits between the opposed lips and is retained in interference fit by them.

Figure 4:
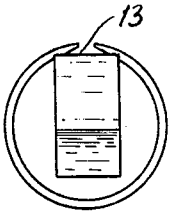
FIG. 4 shows a side view of the mechanical switch according to FIG. 3.
Figure 5:
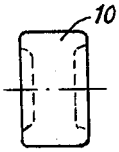
FIG. 5 shows a section of a fusible body of annular form.
Figure 6:
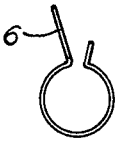
FIG. 6 shows a side view of a ring-like spring having bent extremities.

FIG. 4 shows the open left-hand end of the housing during assembly without fusible body and springs with two profiles visible through the central slot, and the open ceiling slot 13 in the view.

In the assembly of the mechanical switch, the spring 11, which is a cantilever leaf-spring tempered at a right angle, is inserted with its longest portion leading as an interference fit into the swallow-tail opening so that the long portion lies parallel and under the lips of the ceiling slot, being retained by the lips, and the force-fit on the springs towards the right angle serving both as a retention and as a fulcrum for the cantilever when the long portion is bent downwards. On assembly, this portion is bent downwards by an assembly pin inserted through the ceiling slot, until it rests against the profile section 9, whereafter the fusible body 10 and the ring-like spring 6, open under tension and both parts being mutually locked together by this tension, are inserted into the housing 7 through the open end shown in FIG. 4. The housing 7 is thereafter sealed at this open end with a cap 14 which is provided with an oblong horizontally disposed insertion opening 15 for the insertion and retention of the spring member 6, which is thus secured at one end and prevented from rotating. The cap 14 is arranged as an interference fit into the housing.

The fusible body 10 with its fitted ring-like spring 6 now rests against the profiled portion 8, the ceiling of the inner slot of the housing and the end cap 14, and on removal of the assembly pin from holding down the cantilever spring 11, the latter is retained in position by the extremity of the ring-like spring 6 as shown. Spring 6 and spring 11 are now in electrical contact at this point, and the other ends of both springs are firmly held, in the case of the ring-like spring by the insertion hole in the end cap 14 and in the case of the cantilever spring by its interference fit and fulcrum in the swallow-tail in the right hand end wall of the housing shown in FIG. 3.

In addition from FIGS. 1 and 2 it will be seen that the free extremity of the ring-like spring 6 is also rigidly affixed to the cap 4 by soldering thereto only after the assembled springs have taken up tension. The resilient spring contact members II and 6 now ensure electrical contact which is maintained until the temperature rises to such a degree that the fusible body 10 melts or disintegrates, and through which process the fusible body 10 collapses under the resilient pressure of the spring 6 combined with the pressure exerted by the spring II. When the fusible body 10 collapses under pressure thereon, electrical contact between springs 6 and 11 is maintained under pressure right up until the extremities of the two springs part, the separation gap, then accelerated by the released moment of spring 11 together with the continued torsion moment of ring-like spring 6, increasing rapidly in a complex function of acceleration, one spring end accelerating in a shallow vertical arc and the other, the sole moving end of the ring-like spring, in a tight arc towards its other anchored end.

The operation of the device in its entirety is as follows:

When the temperature of the installation rises, the temperature of the controlling device according to the invention also rises and through which the temperature of the positive temperature coefficient thermistor rises. Due to the rise in temperature of the positive temperature coefficient thermistor, there is an increase in the resistance thereof so that there is a decrease in the flow of current flowing through the control device to the installation to be protected with a consequential fall in the temperature thereof and thus a fall in the temperature of the positive temperature coefficient thermistor. The mechanical switch therefore always remains closed. As soon as the positive temperature coefficient thermistor ceases to function efficiently, the temperature increases still further to a temperature at which the fusible body collapses whereupon the contacts open and the flow of current is broken. Hereafter, the control device in its entirety, and of which the total dimensions correspond to those of the usual type of safety fuse, can be easily removed and replaced by a new control device according to the invention. The manufacture of the control device can, due to its standardised dimensions which correspond to the dimensions of the usual type of safety fuse, be effected by means of known automated techniques and machines therefor.

The end caps 4 can be provided with wires 5 and 6 extending outward therethrough, or can be produced without extending wires.

Figure 7:
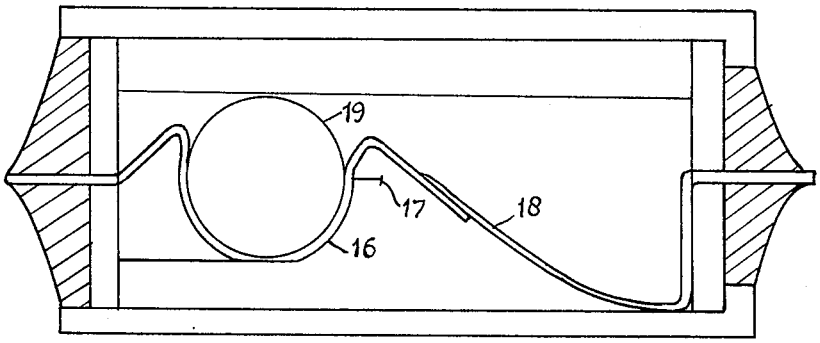
FIG. 7 shows, in section, an other embodiment of this mechanical switch according to the invention.

In FIG. 7 an other embodiment is represented of the mechanical switch according to the invention. Therein the open sping-ring 16 presses with its bent end 17 from the lower side against the other resilient contact means 18 with a force which is directed against the spring works of the resilient conact means 18, so that on collapsing of the fusible body 19 at the appropriate opening temperature the spring-ring 16 coils itself into the closed tempered position withdrawing its end from under the contact means 18 until, when both ends part, they part with an acceleration away from each other which is the sum of both an acceleration caused by a torsion spring moment and a cantilever spring moment in opposite directions.

Assembly is effected by inserting each spring into an end cap so that the stakes open out and retain the springs in a loose fit. The fusible element assembly is inserted first and the end cap secured. The cantilever spring assembly is then inserted in such a manner as to "cock" the cantilever spring 18 on the top of the extremity of the spring-ring and the end cap is secured.

It should be noted that in the cocked position the cantilever moment of the bent end of spiral torsion or ring spring 17 and the cantilever moment of spring 18 tends to align both springs into maximum contact area due to the fact that the springs float at their anchorages.

The invention has hereinbefore been described in relation to an example of an embodiment thereof, but it is not limited thereto; there are a number of variations which, however, fall within the scope of the invention.

I claim:

1. A thermal cut-off switching device for connection in series with an electrical component or appliance which is liable to failure from overheating if the energizing current continues without interruption above a known temperature, said device comprising a shaped cylindrical fusible element, a circular spring evenly gripping said shaped cylindrical fusible element, a miniature cylindrical housing of insulation material containing said fusible element and said circular spring, with an end cap fitted to said housing anchoring one end of said circular spring in a floating anchorage, a cantilever spring detained by said circular spring in balanced electrical contact, said cantilever spring being anchored at its fulcrum by fitting into a slot formed by said housing said electrical contact between said two springs being balanced into parallel surface contiguity by at least one of said springs having a floating anchorage, said balanced electrical contact being maintained on a surface of the cantilever spring by an extremity of the circular spring, said electrical contact adapted for termination by the removal of the extremity of said circular spring from contact with the surface of said cantilever spring, the instantaneity of contact breakage being decided by the mechanical termination of said cantilever spring and the resultant acceleration of said cantilever spring about its fulcrum to its tempered position, said removal of the extremity of said circular spring being caused by the collapse of said fusible element at a predetermined temperature thus permitting said circular spring to coil up on itself in the direction of its other anchored extremity, any slow or creeping movement preceding the collapse of said fusible element not being transmitted to the actual separation of the two contacts, this separation being decided solely by the mechanical construction, this separation of the ends of said two springs being accelerated after the release point by the summation of accelerations in opposite directions caused by the moments of both said springs acting in complex functions of arc, said acceleration reducing the formation of flame, welding and arc when an electric current is broken.

2. A device according to claim 1, further characterized by said circular spring being a spiral torsion spring having a bent end, said torsion spring detaining said cantilever spring by said bent end acting as a deteret on the upper side of said cantilever spring.

3. A device according to claim 1, further characterized by said circular spring being a spring ring having a bent end, said spring ring detaining said cantilever spring by said bent end from the upper side of said cantilever spring.

4. A device according to claim 1, further characterized by said circular spring having a bent end, said circular spring detaining said cantilever spring by said bent end from the lower side of said cantilever spring.

5. A device according to claim 1, further characterized by said fusible element being of a thermally slow softening material.

6. A device according to claim 1, further characterized by said cylindrical housing having an oblong slot through which an end of said circular spring extends and which fixes said end.

7. A device according to claim 1, further characterized by said cylindrical housing having a slot in its upper side, said slot having an upper width narrower than the width of said cantilever spring which extends therethrough.

8. A device according to claim 1, further characterized by said cylindrical housing having an inner profile shaped to support said circular spring and to receive said cantilever spring pressed thereagainst.

9. A device according to claim 1, further characterized by a thermistor with a positive temperature coefficient connected in series with said springs.

* * * * *